US008895114B2

(12) United States Patent
Poulakis

(10) Patent No.: US 8,895,114 B2
(45) Date of Patent: Nov. 25, 2014

(54) METHOD AND DEVICE FOR FUNCTIONALIZING THE SURFACES OF ADHESIVE CLOSURE PARTS

(75) Inventor: Konstantinos Poulakis, Hildrizhausen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 1419 days.

(21) Appl. No.: 12/226,527

(22) PCT Filed: May 26, 2007

(86) PCT No.: PCT/EP2007/004709

§ 371 (c)(1),
(2), (4) Date: Oct. 21, 2008

(87) PCT Pub. No.: WO2007/147479

PCT Pub. Date: Dec. 27, 2007

(65) Prior Publication Data

US 2009/0311438 A1 Dec. 17, 2009

(30) Foreign Application Priority Data

Jun. 22, 2006 (DE) ..... 10 2006 028 581

(51) Int. Cl.

| | |
|---|---|
| ***H05H 1/24*** | (2006.01) |
| ***H05H 1/30*** | (2006.01) |
| ***B27N 3/14*** | (2006.01) |
| ***B29C 35/12*** | (2006.01) |
| ***A44B 18/00*** | (2006.01) |

(52) U.S. Cl.

CPC ..... *A44B 18/0049* (2013.01)
USPC ..... 427/569; 427/575; 425/174; 425/174.8 R; 425/174.8 E

(58) Field of Classification Search

USPC ..... 264/470, 447; 427/535, 536, 540, 553, 427/569, 575; 118/44, 620; 425/174, 425/174.8 R, 174.8 E, 363, 435, 383

See application file for complete search history.

(56) References Cited

U.S. PATENT DOCUMENTS

| | | | | |
|---|---|---|---|---|
| 3,490,107 | A | 1/1970 | Brumlik | |
| 4,404,256 | A * | 9/1983 | Anand et al. | 428/409 |
| 6,299,787 | B1 * | 10/2001 | Li et al. | 216/34 |
| 6,733,860 | B1 * | 5/2004 | Poulakis | 428/100 |
| 6,878,332 | B2 * | 4/2005 | Tachauer et al. | 264/471 |
| 2004/0020591 | A1 * | 2/2004 | Tuma | 156/242 |
| 2004/0134045 | A1 * | 7/2004 | Poulakis et al. | 24/442 |

FOREIGN PATENT DOCUMENTS

| | | |
|---|---|---|
| DE | 690 27 824 T2 | 12/1996 |
| DE | 199 06 008 A1 | 8/2000 |

(Continued)

*Primary Examiner* — Michael Wieczorek

(74) *Attorney, Agent, or Firm* — Roylance, Abrams, Berdo & Goodman LLP

(57) ABSTRACT

The invention relates to a method for functionalizing the surfaces of adhesive closing parts which form, with correspondingly formed adhesive closing parts, an adhesive closure that can be repeatedly opened and closed. The surface energy of the adhesive closing part is modified by means of a proton and/or electron exchanging medium, especially in the form of donors or collectors, using high energy in such a way that the physicochemical properties of the material of the adhesive closing part can be adjusted without a coating and with ageing resistance, by the attachment of functional groups of the exchanging medium to the adhesive closing part material. The invention also relates to a device for carrying out one such method.

30 Claims, 1 Drawing Sheet

(56) References Cited

FOREIGN PATENT DOCUMENTS

| | | | |
|---|---|---|---|
| DE | 101 23 205 | A1 | 11/2002 |
| DE | 102 07 194 | C1 | 6/2003 |
| DE | 10 2004 058 257 | A1 | 6/2006 |
| EP | 0 387 904 | A2 | 9/1990 |
| EP | 1 077 620 | B1 | 2/2001 |
| EP | 1 082 031 | B1 | 3/2001 |
| WO | WO 03/051148 | A1 | 6/2003 |

* cited by examiner

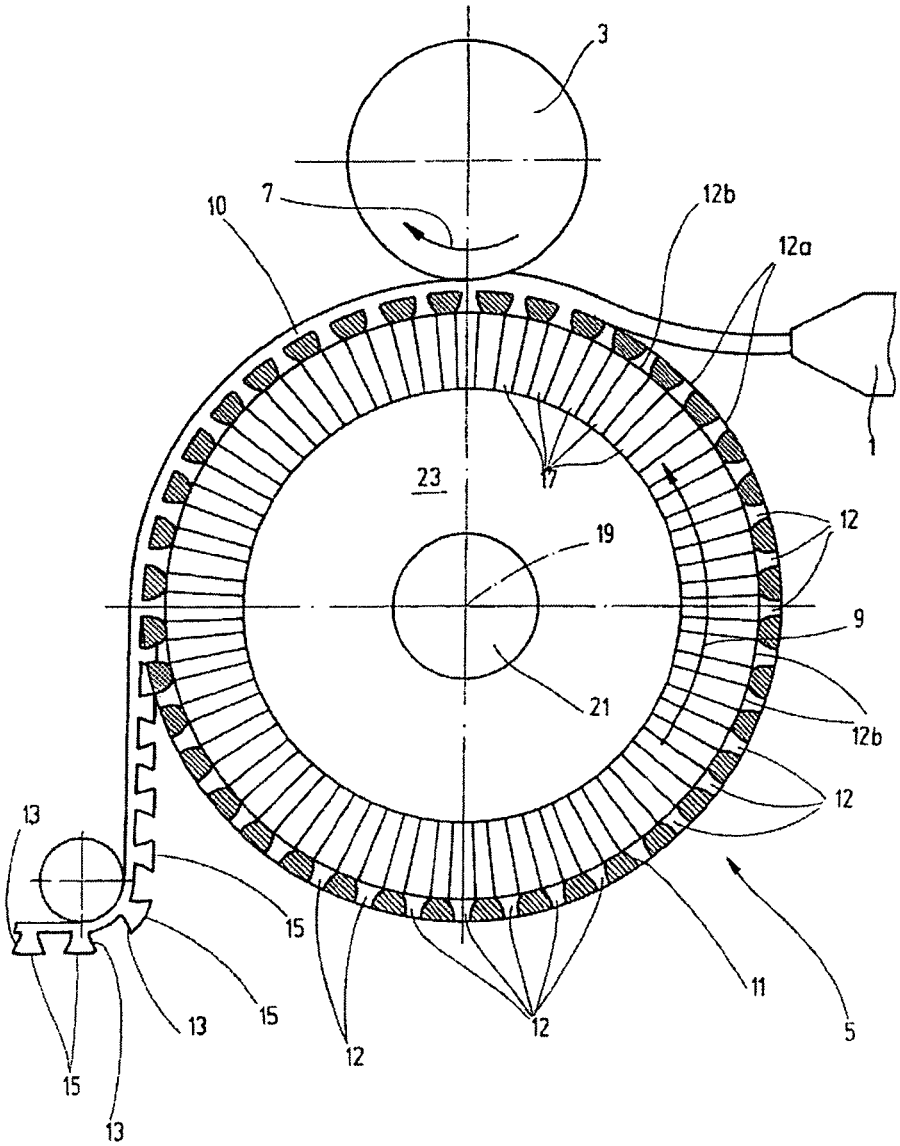
3
7
10
12b
12a
1
17
23
19
12
9
21
12b
12
13
15
15
13
15
13
12
12
12
11
5

METHOD AND DEVICE FOR FUNCTIONALIZING THE SURFACES OF ADHESIVE CLOSURE PARTS

FIELD OF THE INVENTION

The invention relates to a method and device for functionalizing the surfaces of adhesive closure parts which form an adhesive closure that can be repeatedly opened and closed with complimenting adhesive closure parts.

BACKGROUND OF THE INVENTION

EP 1 082 031 discloses a method for producing adhesive closing elements having adhesive closing parts made of plastic materials. The adhesive closing part with the adhesive closing elements are provided at least partially with a coating having thickness that it does not adversely affect the subsequent operation of the adhesive closure. The coating on the adhesive closing part is formed by way of a so-called sol-gel method, preferably based on $SiO_2$ and/or $TiO_2$ modified $SiO_2$. The coating which has been applied by the indicated sol-gel method is foam-repellant. This provides advantages in the event the known adhesive closing part is being used when seat cushion parts are foamed. Although the applied coating is a nanocomposite, i.e., the layer thickness can be extremely small, in particular has only a few molecule thicknesses of the respective coating agent, this coating is not resistant to wear, and thus, is not resistant to ageing.

EP 1 077 620 B1 discloses an adhesive closing part, in particular for foaming for cushion parts of vehicle seats. In their production, one side of the adhesive closing part is applied with an adhesive primer. When the adhesive closing part is a polyamide material, the adhesive primer is formed from resorcinol and/or at least one derivative thereof. When the adhesive closing part consists of a polyolefin material, the adhesive primer is a polyurethane or a polymer formed by way of re-crosslinking of hardenable resins. In this way, an additional coating of a primer layer is formed on the adhesive closing part which creates a high-strength connection to the respective foam material, even without use of the corresponding adhesive agents. This known solution to an application coating can also wear off.

To counteract this, DE 101 23 205 A1 discloses a method for producing an adhesive closing part with a plurality of adhesive closing elements made in one piece with a backing. The interlocking heads of the adhesive closing elements are provided with a head part of an additional duroplastic molding material which can be hardened. Preferably the material is an acrylate, and particularly, a urethane diacrylate. Provided that this urethane molding mass material has cured, an adhesive closing part is formed which on the one hand can easily withstand high temperatures and mechanical stresses, and, on the other, with a corresponding configuration leads to improved adhesive and peeling strength values. The high-strength additional coating applied in this way on the adhesive closing elements is geometrically correspondingly large compared to the fastener part. This in turn conflicts with the desired miniaturization of the adhesive closing parts for which attempts are currently being made to accommodate several thousand adhesive closing elements on a square centimeter of the carrier material of the adhesive closing part.

SUMMARY OF THE INVENTION

Proceeding from this prior art, therefore the object of the invention is to further improve the known method and associated devices such that miniaturized adhesive closing parts are functionalized by surface technology in large throughput rate in a cost-favorable manner such that a plurality of surface and structure properties of the most varied type can be produced with only one basic concept of treatment steps.

These and other aspects of the invention are basically attained by providing a method functionalizing the surface of an adhesive closure member having a plurality of fastener elements adapted for mating with a corresponding closure member. The method comprises the step of subjecting the surface of the fastener elements of the closure member with a proton and/or electron exchange medium in the form of donors and collectors to modify a surface energy and to introduce a functional group to the surface to resist aging of the closure part without the use of coatings.

A further aspect of the invention is attained by providing an apparatus for producing the closure member comprising: a mold screen having a first side and a second side, and a plurality of openings extending between the first side and second side; a dispenser for introducing a plastic material to the first side and into the openings for forming the closure member with a plurality of fastener elements; and a discharge unit subjecting the second side of the mold screen and the plastic material in the openings to an electron donor exchange medium in the form of donors and collectors to modify a surface energy and to introduce a functional group to the plastic material to resist aging without the use of coatings.

Another aspect of the invention is attained by providing a method of producing a closure member having fastener elements with a functionalized surface comprising the steps of providing a mold screen having a first side and a second side, and a plurality of openings extending between the first side and second side for forming fastener elements. A plastic material is introduced to the first side and into the openings to form the closure member having a plurality of fastener elements. The second surface of the screen is subjected with an electron donor exchange medium in the form of donors and collectors to introduce a functional group to a surface of the closure fastener to resist aging without the use of coatings.

In the method according to the invention, a proton and/or electron exchange medium, in particular in the form of donors and collectors, the surface energy of the adhesive closing part is modified using high energy such that the physicochemical properties of the material of the adhesive closing part can be functionalized and made resistant to ageing without the use of coatings by introducing and attaching functional groups of the exchange medium to the material of the adhesive closing part.

Bronsted acids which act as proton donors and Lewis bases which act as electron donors can release electrons to other materials, such as to the plastic material of an adhesive closing part, have proven to be especially versatile to use. Furthermore there are collectors which accumulate protons and/or electrons in the plastic material of the adhesive closing part and which compared to a redox action influence the surface energy of the adhesive closing part such that in turn it becomes possible for functional groups of exchange media to interact with the adhesive closing part in such a way as to determine function using high energy.

By functional groups of the exchange medium attaching to the material of the adhesive closing part on the surface and penetrating into the material of the adhesive closing part, an essentially coating-free structure is achieved, so that functionalization of the surface can be done on a small scale. This in turn supports the desired miniaturization for the adhesive closing parts in addition to their adhesive closing elements. Since the functional groups attach to the adhesive closing part in the molecular range, and in this respect interact with the plastic material of said closing part, this manner of action is resistant to ageing so that the desired surface modification will not be lost after a longer embedding time for the adhesive closing parts before their use in the production of the user. The physicochemical properties to be set are defined within a wide framework. Thus the adhesive closing part can be functionally adjusted or modified to modify its hardness or softness and provide the desired temperature resistance. Resistance to chemicals of any type can likewise be functionally adjusted, such as a desired reaction pattern with third products, for example, a polyurethane foam used as the material in the production of seat part cushioning.

By the attachment of chemical functional groups to the material of the adhesive closing part, a specific interaction can be achieved with the respective part on which the adhesive closing part is to be used. For example, it is possible, by the attachment of the corresponding functional groups, to make the adhesive closing part flame-resistant. This is one criterion of use of adhesive closing part when used in the fields of aeronautics and astronautics. If the respective functional group has luminophore portions, the respective adhesive closing part can be easily used in the creative design field in order, for example, to enable luminescent color designs. The indicated change of the surface energy moreover makes it possible to achieve improved adhesion of the corresponding adhesive closing parts with the formation of the adhesive closure, for which otherwise capillary technologies (DE 102 07 194 C1) which are complex to implement are described in the prior art.

Furthermore, the electrical discharge properties of the adhesive closing part in current transport or other information transport can be improved by the functional groups to be used. The plurality of possible applications is potentially not covered at present and will be the topic of further technical development using the above described method according to the invention.

DETAILED DESCRIPTION OF THE INVENTION

A preferred device for implementing the method according to the invention form the adhesive closing elements of the adhesive closing part using a mold screen. One side of the mold screen is supplied with the plastic material for the closure elements to introduce the plastic material into openings in the mold screen. Preferably in situ an exchange medium is supplied to the mold openings on the opposite side of the mold screen. In an especially cost-effective manner this device allows implementation of the production method according to the invention and a controlled process sequence. With this device large numbers of adhesive closing parts with surface modification can be more or less continuously produced in controlled production.

The FIGURE schematically shows parts of a device for executing the method according to the invention. An extruder head 1 as a supply device, in particular for a thermoplastic material which is in the plastic or liquid state, supplies the thermoplastic material as a strip having a width corresponding to that of the adhesive closing part to be produced. The plastic material is introduced to the gap between a pressure tool and a molding tool 5. The pressure tool is a pressure roll 3. Both rolls are driven in the directions of rotation indicated in the FIGURE with curved arrows 7 and 9 so that between them a conveyor gap is formed through which the plastic strip is conveyed in the transport direction, while at the same time in the gap as the shaping zone the plastic strip is shaped into the backing 10 of the adhesive closing part and the backing 10 on the side adjoining the molding roll 5 acquires the shape which is necessary for forming the interlocking means by the shaping elements of the molding roll 5.

For this purpose the molding roll 5 on the periphery has a screen 11 with individual mold cavities 12. One such mold cavity 12 which is bordered on both sides by mold openings 12*a, b* is preferably regularly distributed with other mold cavities 12 along the molding roll 5 with its screen 11 on the external peripheral side, the distribution and number being freely selectable. The respective mold cavity is made as a rotation hyperboloid so that respectively shaped stem parts 13 are formed which, with their respective base end, are connected in one piece to the strip-like carrier material 10 and whose other free end terminates in a peripherally widened head part 15. Both the stem part 13 and also the head part 15 each form an adhesive closing element for the adhesive closing part as a whole which, with the correspondingly shaped respective closure parts of another adhesive closing part which is not detailed, forms an adhesive closure which can be repeatedly opened and closed. Closures formed in this way have also become known under the trademark Velcro® closures.

The molding roll 5 is provided with openings in the form of media channels 17 which are oriented in terms of their longitudinal alignment to the center 19 as the axis of rotation of the molding roll 5. Within the molding roll 5 and in a concentric arrangement to it, there is a high energy source which is designated as 21 and which is shown symbolically. Furthermore, between the exterior jacket of the high energy source 21 and the interior periphery of the molding roll, there is an empty space which is used for supply and temporary storage of the exchange medium, and optionally the physical parameters of this empty and working space, for example, in the form of pressure and temperature, moisture content, etc., can be adjusted. Furthermore, an optional supply of gas media and fluid media for implementing the method can take place via the pertinent empty or working space 23, for example, in order to accelerate the progress of the pertinent work. Flushing media can be supplied by way of the media channels 17 and also by way of the space 23 in order to remove potential residues from the overall production device during processing according to the method.

Polyolefins have proven especially well suited as the plastic material for the respective adhesive closing part to be produced. This group includes, for example, polyethylenes, polypropylenes, polybutenes, as well as polyisobutenes and poly(4-methyl-1-pentene)s, polymers of the higher α-olefins, such as poly(1-hexene), poly(1-octene), or poly(1-octadecene). These polyolefins should also include copolymers of different olefins, for example, those of ethylene with propylene. Another good feedstock for the adhesive closing parts to be produced is polyester.

Proton and/or electron exchange media are substances and groups of substances according to the follow chemical reference list, the so-called hard bases being designated as I, the soft bases II and the boundary cases of bases being designated as III. The hard acids are designated as IV, the soft acids V and the boundary cases of suitable acid materials are designated as VI.

| I |
| --- |
| $H_2O$ $OH^-$ $F^-$ |
| AcO $SO_4^{2-}$ $Cl^-$ |
| $CO_3^{2-}$ $NO_3^-$ ROH |
| $RO^-$ $R_2O$ $NH_3$ |
| $RNH_2$ SiOH |

-continued

| |
|---|
| II |
| $R_2S$ RSH $RS^-$<br>$I^-$ $R_3P$ $(RO)_3P$<br>$CN^-$ RON CO<br>$C_2H_4$ $C_6H_6$<br>$H^-$ $R^-$ |
| III |
| $ArNH_2$ $C_5H_5N$<br>$N_3^-$ $Br^-$<br>$NO_2^-$ |
| IV |
| $H^+$ $Li^+$ $Na^+$<br>$K^+$ $Mg^{2+}$ $Ca^{2+}$<br>$Al^{3+}$ $Cr^{2+}$ $Fe^{3+}$<br>$BF_3$ $B(OR)_3$ $AlMe_3$<br>$AlCl_3$ $AlH_3$ $SO_3$<br>$RCO^+$ $CO_2$<br>HX<br>(hydrogen-binding molecules) |
| V |
| $Cu^+$ $Ag^+$ $Pd^{2+}$<br>$Pt^{2+}$ $Hg^{2+}$ $BH_3$<br>$GaCl_3$ $I_2$ $Br_2$<br>$CH_2$ carbenes |
| VI |
| $Fe^{2+}$ $CO^{2+}$ $Cu^{2+}$<br>$Zn^{2+}$ $Sn^{2+}$ $Sb^{3+}$<br>$Bi^{3+}$ $BMe_3$ $SO_2$<br>$R_3C^+$ $NO^+$ $GaH_3$<br>$C_6H_5^+$ |

The classification is done according to the pattern that hard acids like to combine with hard bases, and soft acids with soft bases. The transitions between media designated as hard and soft are fluid, and this classification is intended fundamentally to provide only a rough idea and information about the action of the exchange media. Thus, for example, the potential proton release which occurs in Bronsted acid-base reactions is classified as a hard acid. The soft bases as so-called donors are in turn characterized in that several electrons or electron pairs in particular can be released in order in this way to be able to undertake surface functionalization for the adhesive closing part. For influencing the functionalization of the surface of the adhesive closing part, basically so-called collectors are available which in the manner of a redox reaction can pick electrons and/or protons out of the plastic material of the adhesive closing part in order to exert an influence; only the degree of functionalization which can be achieved in this way clearly takes second place to the proton and/or electron donors.

The desired surface modification can be further optimized by using a high energy source. In addition to using microwave radiation or another high frequency field, the use of plasmas is possible. Possible plasma sources are DC voltage glow discharges such as high frequency discharges and those of a microwave nature. In order to reduce the thermal burden on the plastic material to be produced, in particular microwave discharge is recommended since the hardware cost for this is low, coupling without an electrode is possible, and, as a result of the high degree of ionization of the plasma, short process times are ensured; this is critical for in situ production of the adhesive closing part.

Such a plasma source would then be the high energy source designated as 21 as shown in the FIGURE. A plurality of conceivable plasma modification processes can be carried out by virtue of the substrate position of the adhesive closing part in the mold cavities 12 of the mold screen 11. Thus the device shown in the FIGURE is possible, for example, for a so-called in-plasma process in which the surface to be functionalized is located directly in the plasma zone. Likewise a so-called down-stream process would be conceivable in which a process gas is routed through a plasma zone and then can be supplied to the substrate as an adhesive closing part with its free head ends on adhesive closing elements. In particular, by adjusting the distance by way of the drum diameter of the molding roll 5, the thermal load for the substrate in the form of the adhesive closing part thus can be set low.

If the process gas used in the plasma zone should be reacted too quickly or completely all at once, a so-called afterglow process is possible, an inert carrier gas, for example, in the form of nitrogen gas being routed through the plasma zone and activating the process gas which can be supplied only downstream from the plasma zone. The working gas which is then activated, that is, indirectly, is used for the desired surface modification.

Since the drum-like production device can be sealed on the drum ends, routing of the process gas can be undertaken and adjusted in this respect by way of suitable inlets and outlets (not shown) in the empty or working space 23. To accelerate the process it can be advantageous to supply the process gas under the correspondingly high pressure into the space 23. Instead of a plasma generation source, for the production method according to the invention there can also be a dielectric barrier discharge, with a modified field source as a high energy source 21 which from the middle of the molding roll 5 builds up a dielectric field in the direction of the top of the substrate of the adhesive closing part. Furthermore, a treatment gas mixture is more or less continuously delivered into the empty and working chamber 23. The gas mixture consists preferably of a carrier gas and a reducing gas and/or an oxidizing gas at a pressure which in this case can be more or less equal to the atmospheric pressure. The oxidizing gases here are in particular $CO_2$ or $N_2O$ and the reducing gas is $H_2$. It has also proven favorable to settle the content of the oxidizing gas in the mixture in a range from 50 to 2,000 ppmv and the content of the reducing gas is preferably in a mixture in the range of values from 50 to 30,000 ppmv.

With the latter surface treatment method, amino, amido and/or imido groups and compounds can be used in particular as electron donors, which as a functional group on the top of the adhesive closing part delivers an $NH_3$ group which with other functional groups allows a so-called asymmetrical urea bond which has another reactive group on which the polyurethane of the foam material in the cushion foam region can be settled. This leads to exceptionally good binding of the adhesive closing part in the mold foam in this way. By way of a corresponding adhesive closing part an appropriate covering material can then be again detachably joined to the foamed-in adhesive closing part which forms the asymmetrical urea bond to the indicated foam material.

In addition to production use of a revolving screen as shown in the FIGURE, it is also possible to wind the mold screen arrangement in one plane and then the mold screen can be routed through the respective devices which then generate the corresponding surface modification, as described above. In particular, the screen can then be made as a conveyor belt over deflection rolls with an upper and a lower strand, the upper strand being used for shaping and the lower strand being used for removing the adhesive closing part from the individual mold cavities.

The adhesive closing part as shown in the FIGURE does not need to be provided with head ends which are peripherally widened to provide an interlocking action. Rather modern adherence systems can also acquire a surface modification in this way. Thus, for example, DE 100 65 819 C1 shows a method for producing adhesive closing parts in which a carrier material in at least one partial region of its surface is provided with adhesive closing elements or adhesive elements which project out of its plane, in which a plastic material which forms the elements is applied to the carrier element as a carrier part 10, the elements being made at least in a partial region without a molding tool, in which the plastic material is deposited in droplets which are delivered in sequence by means of at least one application device. Although the application device by way of its nozzle delivers plastic material with a droplet volume of only a few picoliters, in this way a fast process sequence can be implemented so that an adhesive closing part is generated in an extremely short time. An adhesive closing part which has been produced in this way also can be surface-modified with the described method.

The device shown in the FIGURE can also be miniaturized in terms of the mold cavities 12 such that adhesive elements can be produced whose adherence takes place mainly by means of vander-Waals forces. Such a closure system is shown, for example, in DE 10 2004 012 067 A1. In spite of the high degree of miniaturization achieved in this way, with the pertinent solution according to the invention it is then possible to modify these nano-adhesive closing parts relative to their surface as specified. The above described device is especially suited in terms of the front side of the head closure material to influencing the respective adhesive closing part. But fundamentally all components of the closure part can optionally be functionalized in terms of their surface with different devices. This also applies especially to the rear side of the backing of the adhesive closing part facing away from the elements or to the top of the stem material which extends between the backing and the bottom of the closure head. For this functionalization of the surface the adhesive closing part with the component or component side to be functionalized is to be supplied open, that is, in an exposed manner, to the functionalization source; this can take place in closed systems but also in open systems in passage for more or less continuous functionalization.

The invention claimed is:

1. A method of functionalizing the surface of an adhesive closure member having a plurality of fastener elements adapted for mating with a corresponding adhesive closure member, said method comprising the step of:

subjecting the surface of the adhesive closure member including the plurality of fastener elements with a proton and/or electron exchange medium in the form of donors and collectors to modify a surface energy and to introduce a functional group to the surface of the adhesive closure member to resist aging of the adhesive closure member and where said fastener elements are free of coatings after introduction of the functional group.

2. The method according to claim 1, wherein the process further comprises attaching the functional group by using high frequency radiation, an electrical field, or a plasma-supported field.

3. The process of claim 2, wherein the attaching of the functional group is by high frequency radiation, said high frequency radiation being microwave radiation.

4. The process of claim 2, wherein the attaching of the functional group is by an electrical field, said electrical field being a dielectric barrier discharge.

5. The process of claim 2, wherein the attaching of the functional group is by a plasma-supported field and by energy in an amount to introduce the functional group to the fastener elements.

6. The method according to claim 1, wherein the step of introducing the functional group is in the presence of an inert gas, reactive gas or mixtures thereof.

7. The method according to claim 1, wherein the step of introducing the functional group is at a predetermined temperature and/or pressure.

8. The method according to claim 1, wherein said closure part is thermoplastic material.

9. The method according to claim 8, wherein said thermoplastic material is selected from the group consisting of polyolefins, polyesters, and mixtures thereof.

10. The method according to claim 1, wherein said electron donor is at least one selected from the group consisting of amino, amido, imido groups, and combinations thereof.

11. The method according to claim 10, wherein the electron donor forms asymmetrical bonds with the parent material of the adhesive closure member.

12. The method according to claim 11, wherein the electron donor forms an asymmetrical urea bond with the adhesive closure member.

13. The method according to claim 12, wherein the adhesive closure member is attached to a polyurethane foam.

14. The method according to claim 1, wherein the functional group is introduced to the adhesive closure member in situ.

15. The method according to claim 1, wherein the adhesive closure member is produced by a screening process.

16. The method of claim 1, wherein said proton and/or electron exchange medium is a basic or acidic medium.

17. The method of claim 1, further comprising forming said adhesive closure member in a mold and subjecting the fastener elements to the proton and/or electron exchange medium while in the mold.

18. The method of claim 1, further comprising forming said adhesive closure member in a mold having a plurality of mold cavities and subjecting the fastener elements within the mold cavities to the proton and/or electron exchange medium.

19. The method of claim 1, further comprising subjecting said fastener elements to said proton and/or electron exchange medium.

20. A method of producing a closure member having fastener elements with a functionalized surface comprising the steps of:

providing a mold screen having a first side and a second side, and a plurality of openings extending between said first side and second side for forming fastener elements;

introducing a plastic material to said first side and into said openings to form the closure member having a plurality of fastener elements; and subjecting the second surface of the screen with a proton and/or electron donor exchange medium in the form of donors and collectors to introduce a functional group to a surface of the fastener elements to resist aging without the use of coatings.

21. The method of claim 20, wherein said electron donor exchange medium is subjected to the second surface of the screen in the presence of an energy source selected from the group consisting of microwave radiation, dielectric barrier discharge and plasma discharge.

22. The method of claim 20, wherein said plastic material is a thermoplastic material.

23. The method of claim 20, wherein said plastic material is a polyurethane.

24. The method of claim 23, wherein said proton and/or electron donor exchange medium includes $NH_3$ and forms an asymmetrical urea bond with said polyurethane.

25. The method of claim 20, wherein said proton and/or electron donor exchange medium includes an acid capable of forming a functional group on said plastic material.

26. The method of claim 20, wherein said proton and/or electron donor exchange medium includes a base capable of forming a functional group on said plastic material.

27. The method of claim 20, wherein said proton and/or electron donor exchange medium includes an amino group, amido or imido group.

28. The method of claim 20, wherein said proton and/or electron donor exchange medium includes a Bronsted acid or Lewis base.

29. An apparatus for carrying out the method of claim 1, wherein said apparatus includes a mold screen having a first side for receiving a plastic material and forming the adhesive closure member and a second side for subjecting the plastic material to the proton and/or electron exchange medium.

30. An apparatus for producing a closure member, comprising:

a mold screen having a first side and a second side, and a plurality of openings extending between said first side and second side;

a dispenser for introducing a plastic material to said first side and into said openings for forming the closure member with a plurality of fastener elements; and a discharge unit subjecting said second side of the mold screen and the plastic material in said openings to an electron donor exchange medium in the form of donors and collectors to modify a surface energy and to introduce a functional group to said plastic material to resist aging without the use of coatings.

* * * * *